United States Patent [19]

Stamets et al.

[11] 4,215,648

[45] Aug. 5, 1980

[54] ELECTROSTATIC AIR/POWDER STRIPE APPLICATOR

[75] Inventors: Stanley L. Stamets, South Holland; Robert A. Winkless, Oak Lawn; Rafael J. Hernandez, Chicago; Joseph J. Merle, Oak Lawn; Robert D. Payne, Countryside, all of Ill.

[73] Assignee: The Continental Group, Inc., New York, N.Y.

[21] Appl. No.: 936,544

[22] Filed: Aug. 23, 1978

[51] Int. Cl.[2] ..... B05B 5/02; B05C 5/02

[52] U.S. Cl. ..... 118/622; 118/306; 118/317; 118/308; 427/28; 427/181; 427/236; 427/286; 427/424

[58] Field of Search ..... 427/28, 236, 14, 286, 427/181, 187, 421, 424; 118/306, 317, 301, 308, 312, 622; 51/310

[56] References Cited

U.S. PATENT DOCUMENTS 3,545,996 12/1970 Duncan ..... 51/310

4,098,226 7/1978 Furter ..... 118/622

*Primary Examiner*—Roland E. Martin, Jr.

*Attorney, Agent, or Firm*—Charles E. Brown

[57] ABSTRACT

A powder applicator for applying powder to form a side stripe to the interior of can bodies along side seams thereof. The powder applicator includes a device for providing a layering effect on the gas entrained powder so that although the powder is normally carried by the gaseous stream it is directed into an orifice of a nozzle as a dense stream with the carrier gas forming a separate layer. In addition, the applicator forms a seal with the interior of the can body to define a limited sealed area within which the powder may pass. This sealed area contains corona charging pins which are arranged in a longitudinal line so that a maximum charging of the powder may be effected. Also, a diffused gas is directed into the sealed area to prevent the powder from clinging to the side walls of the sealed area and the charging pins.

14 Claims, 6 Drawing Figures

ELECTROSTATIC AIR/POWDER STRIPE APPLICATOR

This invention relates to the electrostatic application of a powder stripe to the interior of tubular bodies, and most particularly to the application of such a powder stripe along side seams of can bodies.

Can bodies, which have welded or soldered side seams, are normally formed from blanks which are coated on the interior surfaces thereof, but wherein the coating is omitted from the edges which are joined together to form the customary side seam. After the body blanks have been formed into tubular bodies and the side seams completed, it is necessary to coat the interior of the resultant bodies along the side seam to cover the uncoated metal.

Prior devices have been provided for internally side striping can bodies and the like including the patent to Manuel, et al U.S. Pat. No. 3,526,027, granted Sept. 1, 1970, and the patent to Winkless, U.S. Pat. No. 3,678,336, granted July 18, 1972.

In the past, during powder application of the side stripe, overspraying occurs which results in the powder being deposited away from the narrow area to positions where it is not wanted and where it is not cured. This uncured powder is considered an adulterant. The adulterant can result in loose powder particles being mixed with the product. Further, when the can bodies are utilized for non-food cans of the aerosol type, the loose powder particles may block the discharge nozzle of such containers.

In accordance with this invention, it is proposed to reduce if not eliminate the stray powder particles which have occurred in the past. First of all, means have been provided wherein the gas entrained powder, immediately before the entrance into the discharge nozzle, is subjected to a centrifuging action so that it is separated from the gas carried and is directed into the orifice of the discharge nozzle in a dense stream occupying only that segment of the orifice which is adjacent the surface to which the powder is to be applied. By eliminating the spray action due to the carrying of the powder particles by the gas carrier, there is a concentration of the powder in a segment of the nozzle orifice so that the powder is directed onto the side seam area in a dense stream.

Another feature of the invention is the sealing off of a limited portion of the interior of the body being striped so as to confine the area where powder may accidentally flow.

The sealed-off area has a diffused gas directed therethrough through side walls thereof so that any bouncing particles are moved about by the pneumatic effect within the sealed area and are subjected to charging so as to be directed to the desired side seam area.

Excess powder which has not been sufficiently charged to adhere to the can body is moved by the diffused gas and in conjunction with a scavenging hood is exhausted between adjacent bodies.

The nozzle is pivotally mounted so that the angle at which the powder stream strikes the body may be adjusted so as to minimize powder particle bounce.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
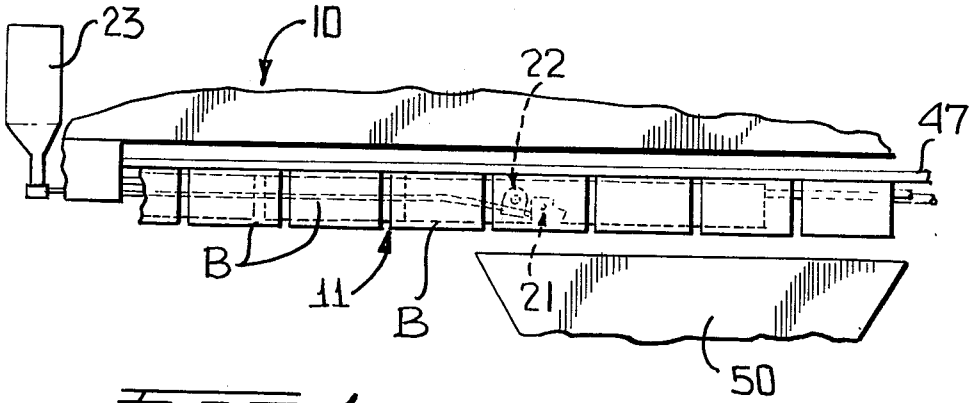
FIG. 1 is a schematic side elevational view of a can line incorporating the powder applicator of this invention.

Referring now to the drawings in detail, in FIG. 1 there is illustrated a body maker, generally identified by the numeral 10. It is to be understood that in the body maker 10 flat body blanks are rolled into cylindrical form and the adjacent edges are secured together to define a longitudinal side seam. The securing together of the body blank edges may be accomplished by welding or by soldering. In the illustrated embodiment of the invention, the bodies have welded side seams. However, the invention is not so limited.

After the bodies, which are generally identified by the letter B, have been formed, they pass along a powder applicator which is the subject of this invention, the powder applicator being generally identified by the numeral 11. The powder applicator 11 is supported from and forms a continuation of the customary horn 12 of the body maker.

Figure 2:
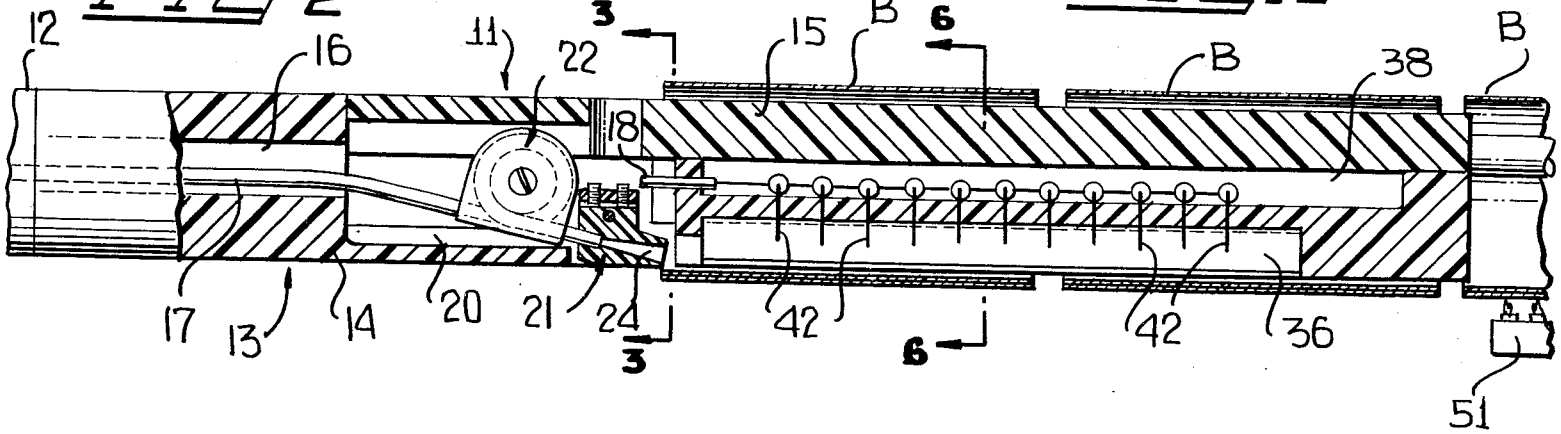
FIG. 2 is a fragmentary side elevational view of the powder applicator portion of the can line, with parts broken away and shown in section.

Referring now to FIG. 2 in particular, it will be seen that the powder applicator 11 includes an elongated support, generally identified by the numeral 13, which carries the various components of the powder applicator and may, at the same time, function as a support for the can bodies which are to be internally side striped. The support 13 includes basically a lower support member 14 and an upper support member 15 which are separately formed and suitably joined together by fasteners (not shown). It is to be understood that the exterior diameter of the support 13 is slightly less than the internal diameter of the can body B, there being a diametrical clearence on the order of 0.030 inch to 0.090 inch.

The rear or left portion of the support 13, as viewed in FIG. 2, has an opening 16 extending longitudinally therethrough which is in communication with a like opening in the horn 12. Lines 17 and 18 extend through the opening 16. The line 17 is a powder supply line, while the line 18 is a combined gas supply line and electrical conduit receiver.

Figure 4:
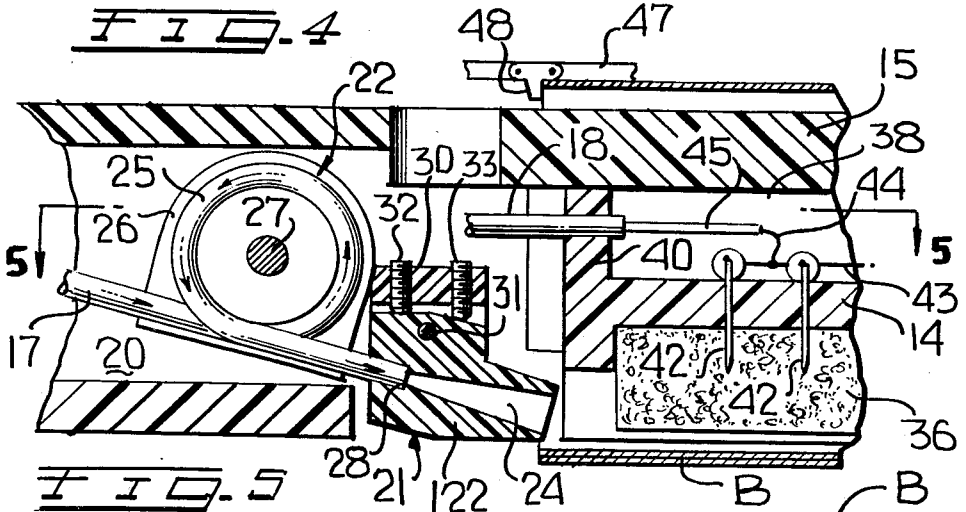
FIG. 4 is an enlarged fragmentary horizontal sectional view of the powder applicator in the vicinity of the nozzle.

A relatively large opening 20 is formed in the support 13 with this opening extending downwardly out of the lower support member 14, and is best shown in FIGS. 2 and 4. In the opening 20 there is mounted both a nozzle, generally identified by the numeral 21, and a device 22 for effecting the separation of the powder from its gas carrier so that there is supplied to the nozzle 21 in a layer of powder and a layer of carrier gas.

It is to be understood that a gas entrained powder supply is directed into the supply line 17 from a source 23 which is of a conventional construction. The carrier gas has entrained therein the powder particles with there being a thorough mixing of the two until the device 22 is reached. Thereafter, the layer effect exists and the powder is directed into an orifice 24 of the nozzle 21 as a dense stream, the powder being in the lower part of the orifice 24 and the gas being in the upper part.

Figure 5:
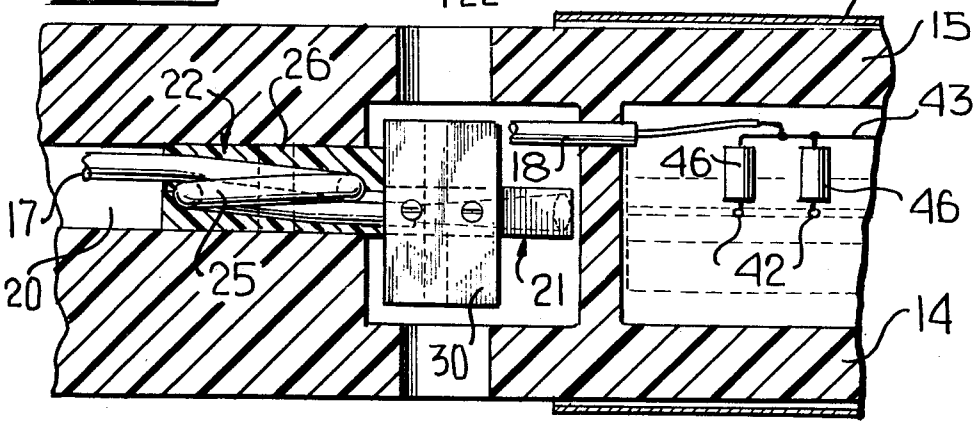
FIG. 5 is an enlarged fragmentary horizontal sectional view taken generally along the line 5—5 of FIG. 4.

The device 22 functions as a centrifuge and basically is a 360° turn 25 in the supply tube 17. The shaped portion of the tube 17 is mounted within a support block 26 so as to maintain the configuration of the 360° turn 25. The support block 26, as is best shown in FIG. 5, tightly fits within the opening 20 and serves to stabilize the supply tube 17. The support block 26 is formed in two halves secured together by a fastener 27.

The nozzle 21 includes a block 122 having a bore 28 which receives the terminal end portion of the supply tube 17. The bore 27 opens into the orifice 24 which is of a slightly flaring construction.

Figure 3:
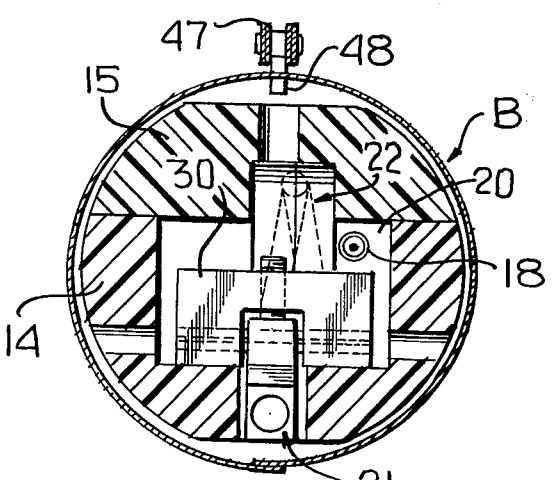
FIG. 3 is an enlarged transverse sectional view taken generally along the line 3—3 of FIG. 2.

The nozzle 21 is mounted within the opening 20 by means of a generally U-shaped cross sectional support block 30 which is mounted within the opening 20 in an inverted position, as is best shown in FIG. 3. The nozzle 21 is pivotally mounted relative to the support block 20 by means of a transverse pivot pin 31. The angle of the axis of the orifice 24 is adjusted by pivoting the nozzle 21 about the pin 31. The nozzle is retained in an adjusted position by means of a pair of set screws 32, 33 carried by the central portion of the support block 30 and bearing against the upper surface of the block 22.

It will be readily apparent from FIG. 4 that the nozzle 21 is positioned closely adjacent the interior surface of a can body B which is to be coated along the side seam thereof. It will be seen that a stream of powder flowing out of the orifice 24 along the lower segment thereof will flow as a dense stream directly onto the inner surface of the can body in the general pattern shown in FIG. 6.

It is to be understood that since the powder is directed onto the can body as a dense stream, there is little tendency for the powder particles to bounce as would occur in the past. Since the powder particles are not carried by the carrier gas, there is no tendency for the particles to flow, and adjacent particles prevent bounce.

It is pointed out here that by concentrating the powder in the area to be coated, the effect of machine vibration on the powder is minimized. Without this feature, the powder, which channels onto the wall of the delivery tube, would be caused to shift from side to side on the delivery tube by machine vibration and cause an uneven distribution of the powder on the can side seam.

It is to be understood that with the powder so supplied, the can body could be heated to cause fusion of the powder to the can body. However, it is desired to provide effective control over all powder dispensed into a can body. Accordingly, the powder applicator 11 includes downstream of the nozzle 21 powder control apparatus.

Most specifically, the powder control apparatus includes a pair of longitudinally extending brushes 34 (FIG. 6) carried by the lower support half 14 and positioned to engage the interior of the can body on opposite sides of the area to which the powder stripe is applied. The brushes 34 specifically define that portion of the interior of the can body subject to the application of powder. It is to be understood that the width of the portion of the can body between the brushes 34 will not exceed the width of the can body which is heated sufficiently to effect powder bonding.

Figure 6:
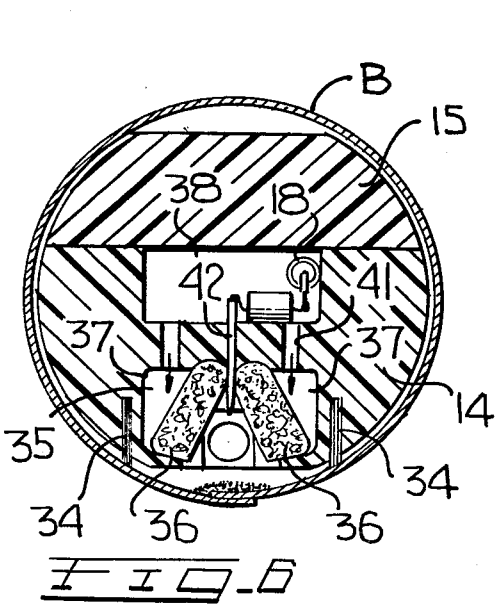
FIG. 6 is an enlarged transverse sectional view taken along the line 6—6 of FIG. 2.

Between that portion of the lower support 14 carrying the brushes 34 there is a longitudinally extending opening 35 which opens out through the lower part of the support half 14, as is best shown in FIG. 6. Mounted within the opening 35 in downwardly diverging relation is a pair of porous blocks 36 which define side walls of a sealed chamber which is in part defined by the brushes 34 and in part by the lower part of the can body being side striped. These blocks 36 in conjunction with the support half 14 define in the outer parts of the opening 35 chambers 37. The chambers 37 receive a suitable gas (air) under pressure with the gas being diffused through the blocks 36 into the sealed chamber. The purpose of this diffused gas supply within the sealed chamber will be described in more detail hereinafter.

The upper part of the support half 14 has a longitudinally extending opening 38 formed therein which is closed by the upper support half 15, as is best shown in FIG. 6. The tube 18 extends through an end wall portion 40 into the opening 38, as is best shown in FIG. 4, and supplies gas under pressure into the opening 38. Passages 41 extend down through the lower support half 14 from the opening 38 into the chamber 37 for supplying the gas thereto under pressure.

At this time it is pointed out that the lower support half 14 also carries a plurality of centrally located, longitudinally spaced corona charging pins 42 which project down into the sealed area as is also best shown in FIG. 6. The corona charging pins 42 are connected to a common feed wire 43 which, in turn, is connected to a wire 44 delivering a source of high voltage d.c. current. The feed wire 44 has insulating covering 45 and extends through the gas supply tube 18, as is clearly shown in FIG. 4.

A suitable resistor 46 is coupled in the circuitry to each corona charging pin 42 from the common feed wire 43 to the pin 42. It is to be understood that the current distributing resistors minimize the tendency of any one corona charging pin to monopolize the charging current at the expense of any other pin's charging efficiency. The corona charging pins function in the usual manner electrostatically to charge the powder by the ions generated at the pins. By having the pins within a confined sealed area, the corona charging pins are effective not only to charge the incoming powder, but also to add an additional charge to any powder particles which bounce without sticking.

It is pointed out at this time that the fluidizing action of the side walls of the sealed chamber through the blocks 36 also tend to keep the particles in suspension, preventing build-up on the walls of the sealed chamber and charging pins as well as allowing more time for the charging of the powder particles.

Due to the very long length of the opening 37 and the longitudinal arrangement of the charging pins 42, there is allowed a relatively long time for the charging of powder from the ions generated at the corona charging pins.

It is to be understood that the brushes 34 are formed of a dielectric material as are all parts of the powder applicator 11 with the exception of the charging pins, resistors and high voltage conductors. The mechanical components can be formed of a suitable plastics material.

It is to be understood that the can bodies B are moved along the powder applicator 11 in closely spaced relation, as is shown in FIG. 2. Preferably, movement of the can bodies is effected by a conveyor chain 47 which is part of the body maker 10 and have conveying dogs or fingers 48 thereon, as is best shown in FIG. 3.

The powder is delivered by the nozzle 21 in a continuous stream, and accordingly there is dispensing of the powder when no can body is in position. The small amount of powder which is not deposited is exhausted by the can bodies by a scavenging hood 50 which is mounted closely adjacent to the side seams of the can bodies, as is best shown in FIG. 1. The scavenging hood 50 has a profound affect on the distribution of the powder with the hood 50 tapering downwardly to provide for a uniform velocity along the length of the hood. It is to be understood that a suction is drawn by the hood 50 so as to draw loose powder out of the can bodies.

Although the powder applicator 11 has been illustrated as applying the powder stripe at the 6 o'clock position, it is to be understood that the principles of the powder applicator can also be applied to cans having their side seams formed at the 12 o'clock position.

Referring once again to FIG. 2, it is to be seen that there is schematically illustrated a heater for heating the can body in the side stripe area so as to effect the bonding of the applied powder to the can body. The heater 51 is conventional and is not a part per se of this invention.

It will be readily apparent that by restricting powder overspraying and limiting powder to a confined area of the can body, not only can there be effected a more efficient side striping of the can body, but also the errant powder particles will all be bonded to the can body thereby eliminating powder particles which can become loose at a later time and form adulterants in foods or, in the case of aerosol cans, causing clogged valves.

Although only a preferred embodiment of the powder applicator has been specifically illustrated and described herein, it is to be understood that minor variations may be made in the power applicator without departing from the spirit and scope of the invention as defined by the appended claims.

We claim:

1. A powder applicator comprising a discharge nozzle having an orifice for directing powder in a stream, a supply line for directing gas entrained powder towards said nozzle, de-entraining means in advance of said nozzle for de-entraining the powder and effecting the supplying of the gas and the powder in separate layers to said nozzle with the powder being concentrated in a preselected sector of said nozzle for effecting the discharging of the powder in a dense stream, and support means for determining a fixed path of axial movement for article portions to be coated, said nozzle orifice opening generally in the direction of article movement and having an axis disposed generally axially coextensive with but at a fixed angle to said axial path, and said orifice sector being disposed adjacent said path.

2. The powder applicator of claim 1 wherein said de-entraining means is centrifuge means.

3. The powder applicator of claim 1 wherein said de-entraining means is centrifuge means in the form of at least a substantially 360° loop in said supply line.

4. The powder applicator of claim 1 wherein said support means is particularly adapted to support tubular bodies of the can body and the like class having a longitudinal side seam, and the longitudinal side seam is the article portion to be coated with the powder.

5. The powder applicator of claim 1 wherein said support means includes a support for supporting tubular bodies, said support carrying downstream of said nozzle longitudinally extending sealing means for engaging the interior of a tubular body on opposite sides of the portion of the body to be coated and forming a longitudinally elongated confined area generally longitudinally aligned with said nozzle axis within which discharged powder may flow.

6. The powder applicator of claim 5 together with means carried by said support separate and apart from said sealing means for supplying diffused gas into said confined area for maintaining floating powder particles in suspension.

7. The powder applicator of claim 6 wherein said means for supplying a diffused gas includes side walls of said confined area being formed of porous material, and gas supply means for directing gas to and through said side walls.

8. The powder applicator of claim 7 together with powder recovery means adjacent the path of tubular bodies for recovering loose powder particles from between adjacent bodies prior to the fusing of said powder particles to said bodies.

9. The powder applicator of claim 6 together with corona charging pins projecting into said sealed area in longitudinally spaced relation.

10. A powder applicator for applying a stripe of powder to a tubular body side seam, said powder applicator comprising support means for supporting tubular bodies for movement along a predetermined path, nozzle means for applying powder as a stripe to the interiors of tubular bodies, said support means carrying downstream of said nozzle sealing means for engaging the interior of each tubular body on opposite sides of the portion to be coated and said support means together with said sealing means forming with each tubular body a confined area within which discharged powder may flow, said support means carrying elements formed of porous material defining side walls of said confined area, and gas supply means for directing gas through said porous material elements.

11. The powder applicator of claim 10 together with powder recovery means adjacent the path of tubular bodies for recovering loose powder particles from between adjacent bodies prior to the fusing of said powder particles to said bodies.

12. The powder applicator of claim 10 together with corona charging pins projecting into said sealed area in longitudinally spaced relation.

13. The powder applicator of claim 1 together with means directly pivotally mounting said nozzle for pivoting about an axis transversely of said path for fixedly adjusting the angle of said orifice to an article being coated.

14. The powder applicator of claim 4 wherein said support means is of a size for receiving tubular bodies having a diameter on the order of 2.5 to 3.9 inch.

* * * * *